US009567808B2

(12) United States Patent
Scott et al.

(10) Patent No.: US 9,567,808 B2
(45) Date of Patent: Feb. 14, 2017

(54) CUTTING ELEMENTS CONFIGURED TO GENERATE SHEAR LIPS DURING USE IN CUTTING, EARTH-BORING TOOLS INCLUDING SUCH CUTTING ELEMENTS, AND METHODS OF FORMING AND USING SUCH CUTTING ELEMENTS AND EARTH-BORING TOOLS

(71) Applicants: Baker Hughes Incorporated, Houston, TX (US); ELEMENT SIX LTD, County Clare (IE)

(72) Inventors: Danny E. Scott, Montgomery, TX (US); Marcus R. Skeem, Sandy, UT (US); Jeffrey B. Lund, Cottonwood Heights, UT (US); John H. Liversage, Gauteng (ZA); Moosa Mahomed Adia, Benini (ZA)

(73) Assignees: Baker Hughes Incorporated, Houston, TX (US); Element Six Ltd, County Clare (IE)

( * ) Notice: Subject to any disclaimer, the term of this patent is extended or adjusted under 35 U.S.C. 154(b) by 0 days.

(21) Appl. No.: 14/339,855

(22) Filed: Jul. 24, 2014

(65) Prior Publication Data

US 2014/0332274 A1 Nov. 13, 2014

Related U.S. Application Data

(62) Division of application No. 12/896,587, filed on Oct. 1, 2010, now Pat. No. 8,800,692.

(Continued)

(51) Int. Cl.
*E21B 10/573* (2006.01)
*C23C 30/00* (2006.01)

(Continued)

(52) U.S. Cl.
CPC ..... *E21B 10/5735* (2013.01); *B24D 3/10* (2013.01); *B24D 18/0009* (2013.01);

(Continued)

(58) Field of Classification Search
USPC ... 175/57, 434, 428, 405.1, 420.2, 379, 430; 51/307

See application file for complete search history.

(56) References Cited

U.S. PATENT DOCUMENTS 4,690,691 A 9/1987 Komanduri
5,135,061 A * 8/1992 Newton, Jr. ..... 175/428

(Continued)

FOREIGN PATENT DOCUMENTS

JP 59219500 A 12/1984
WO 2008102324 A1 8/2008
WO 2012092042 A1 7/2012

OTHER PUBLICATIONS

Adia et al., South Africa Application No. 2007/01621 entitled Cutting Elements filed Feb. 23, 2007.

(Continued)

*Primary Examiner* — Taras P Bemko
(74) *Attorney, Agent, or Firm* — TraskBritt

(57) ABSTRACT

Cutting elements for earth-boring tools may generate a shear lip at a wear scar thereon during cutting. A diamond table may exhibit a relatively high wear resistance, and an edge of the diamond table may be chamfered, the combination of which may result in the formation of a shear lip. Cutting elements may comprise multi-layer diamond tables that result in the formation of a shear lip during cutting. Earth-boring tools include such cutting elements. Methods of forming cutting elements may include selectively designing and configuring the cutting elements to form a shear lip. Methods of cutting a formation using an earth-boring tool (Continued)

include cutting the formation with a cutting element on the tool, and generating a shear lip at a wear scar on the cutting element. The cutting element may be configured such that the shear lip comprises diamond material of the cutting element.

15 Claims, 6 Drawing Sheets

Related U.S. Application Data

(60) Provisional application No. 61/248,279, filed on Oct. 2, 2009, provisional application No. 61/248,183, filed on Oct. 2, 2009.

(51) Int. Cl.

| | |
|---|---|
| ***E21B 10/43*** | (2006.01) |
| ***E21B 10/567*** | (2006.01) |
| ***B24D 3/10*** | (2006.01) |
| ***B24D 18/00*** | (2006.01) |

(52) U.S. Cl.

CPC ..... *C23C 30/005* (2013.01); *E21B 10/43* (2013.01); *E21B 10/567* (2013.01); *B22F 2998/00* (2013.01)

(56) References Cited

U.S. PATENT DOCUMENTS

| | | | | |
|---|---|---|---|---|
| 5,468,268 | A | 11/1995 | Tank | |
| 5,645,617 | A | 7/1997 | Frushour | |
| 5,667,028 | A | 9/1997 | Truax et al. | |
| 5,711,702 | A | 1/1998 | Devlin | |
| 6,481,511 | B2 | 11/2002 | Matthias et al. | |
| 6,601,662 | B2 | 8/2003 | Matthias et al. | |
| 7,493,973 | B2 | 2/2009 | Keshavan et al. | |
| 7,568,534 | B2 | 8/2009 | Griffin et al. | |
| 7,575,805 | B2 | 8/2009 | Achilles et al. | |
| 7,608,333 | B2 | 10/2009 | Eyre | |
| 7,647,993 | B2 | 1/2010 | Middlemiss | |
| 7,754,333 | B2 | 7/2010 | Eyre et al. | |
| 2005/0115744 | A1 | 6/2005 | Griffin et al. | |
| 2005/0139397 | A1 | 6/2005 | Achilles et al. | |
| 2005/0247492 | A1 | 11/2005 | Shen et al. | |
| 2005/0263328 | A1 | 12/2005 | Middlemiss | |
| 2006/0060390 | A1 | 3/2006 | Eyre | |
| 2006/0060391 | A1 | 3/2006 | Eyre et al. | |
| 2006/0086540 | A1 | 4/2006 | Griffin et al. | |
| 2007/0039762 | A1 | 2/2007 | Achilles | |
| 2007/0056778 | A1 | 3/2007 | Webb et al. | |
| 2008/0142267 | A1 | 6/2008 | Griffin et al. | |
| 2008/0142275 | A1 | 6/2008 | Griffin et al. | |
| 2008/0164071 | A1 | 7/2008 | Patel et al. | |
| 2009/0071727 | A1 | 3/2009 | Keshavan et al. | |
| 2009/0152016 | A1* | 6/2009 | Eyre et al. | 175/426 |
| 2009/0218146 | A1* | 9/2009 | Fang et al. | 175/428 |
| 2011/0088950 | A1 | 4/2011 | Scott et al. | |

OTHER PUBLICATIONS

International Search Report for International Application No. PCT/US2010/051148 mailed May 24, 2011, 3 pages.

International Written Opinion for International Application No. PCT/US2010/051148 mailed May 24, 2011, 4 pages.

International Preliminary Report on Patentability for International Application No. PCT/US2010/051148 dated Apr. 3, 2012, 6 pages.

European Supplementary Partial Search Report and Search Opinion for European Application No. EP/10821344, dated Apr. 25, 2016, 8 pages.

* cited by examiner

CUTTING ELEMENTS CONFIGURED TO GENERATE SHEAR LIPS DURING USE IN CUTTING, EARTH-BORING TOOLS INCLUDING SUCH CUTTING ELEMENTS, AND METHODS OF FORMING AND USING SUCH CUTTING ELEMENTS AND EARTH-BORING TOOLS

CROSS-REFERENCE TO RELATED APPLICATIONS

This application is a divisional of U.S. patent application Ser. No. 12/896,587, filed Oct. 1, 2010, now U.S. Pat. No. 8,800,692, issued Aug. 12, 2014, which application claims the benefit of U.S. Provisional Patent Application Ser. No. 61/248,279, filed Oct. 2, 2009, the disclosure of each of which is hereby incorporated herein in its entirety by this reference. This application also claims the benefit of U.S. Provisional Patent Application Ser. No. 61/248,183, filed Oct. 2, 2009, the disclosure of which is hereby incorporated herein in its entirety by this reference.

TECHNICAL FIELD

Embodiments of the present invention generally relate to cutting elements that include a table of superabrasive material (e.g., diamond or cubic boron nitride) formed on a substrate, to earth-boring tools including such cutting elements, and to methods of forming such cutting elements and earth-boring tools.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

PDC cutting elements commonly have a planar, disc-shaped diamond table on an end surface of a cylindrical cemented carbide substrate. Such a PDC cutting element may be mounted to an earth-boring rotary drag bit or other tool using fixed PDC cutting elements in a position and orientation that causes a peripheral edge of the diamond table to scrape against and shear away the surface of the formation being cut as the drill bit is rotated within a wellbore. As the PDC cutting element wears, a so-called "wear scar" or "wear flat" develops that comprises a generally flat surface of the cutting element that ultimately may extend from a front, exposed major surface of the diamond table to a cylindrical lateral side surface of the cemented carbide substrate.

Early PDC cutting elements had relatively thinner diamond tables having an average thickness of about one (1) millimeter or less. As such cutting elements were used to cut formation material, the wear scar that developed often included an uneven profile wherein the surface of the diamond table that was rubbing against the formation projected outward from the cutting element beyond the adjacent surface of the cemented carbide substrate that was rubbing against the formation. It was believed that this phenomenon was due to the fact that the rubbing surface of the cemented carbide substrate was wearing at a faster rate than was the rubbing surface of the diamond table. The portion of the diamond table at the wear scar projecting outward beyond the adjacent rubbing surface of the cemented carbide substrate has been referred to as a "shear lip." The formation of such a shear lip was thought to beneficially result in an increased rate of penetration (ROP), although the shear lip was also frequently believed to be the source of delamination or spalling of the diamond table, which often leads to catastrophic failure of the cutting element.

Due at least partially to improvements in methods of forming polycrystalline diamond tables, PDC cutting elements are commonly fabricated with relatively thicker diamond tables having thicknesses of about four (4) millimeters or more. It has been observed that a shear lip does not often form at the wear scar of such PDC cutting elements when used to cut formation material. Furthermore, as a PDC cutting element wears during use, the total area of the wear scar gradually increases. With PDC cutting elements having relatively thicker diamond tables, the total diamond surface area at the wear scar can reach a magnitude that results in a relatively slow ROP, as the large diamond surface area acts as a bearing surface upon which the cutting element rides across the formation, spreading the applied weight on bit over an unduly large surface area and hindering penetration of the cutting edge of the cutting element into the formation material.

BRIEF SUMMARY

In some embodiments, the present invention includes cutting elements for use in earth-boring tools, which cutting elements comprise a cutting element substrate, at least one layer of polycrystalline diamond material over a surface of the cutting element substrate, and a leading chamfer formed proximate an edge of the cutting element between a front surface of the cutting element and a lateral surface of the cutting element. At least one layer of polycrystalline diamond material comprises about eighty-eight volume percent (88 vol %) diamond or more. Furthermore, the polycrystalline diamond material comprises interbonded grains of diamond material having an average grain size of about fifteen microns (15 μm) or less.

In additional embodiments, the present invention includes cutting elements for use in earth-boring tools, which cutting elements comprise a cutting element substrate, a first layer of polycrystalline diamond material over a surface of the cutting element substrate; and a second layer of polycrystalline diamond material on a side of the first layer of polycrystalline diamond material opposite the cutting element substrate. The first layer of polycrystalline diamond material exhibits a first wear resistance, and the second layer of polycrystalline diamond material exhibits a second wear resistance higher than the first wear resistance.

In yet further embodiments, the present invention includes cutting elements for use in earth-boring tools, which cutting elements comprise a cutting element substrate, a first layer of polycrystalline diamond material over a surface of the cutting element substrate, a second layer of polycrystalline diamond material on a side of the first layer of polycrystalline diamond material opposite the cutting element substrate, and a third layer of polycrystalline diamond material on a side of the second layer of polycrystalline material opposite the first layer of polycrystalline diamond material. The first layer of polycrystalline diamond material exhibits a first wear resistance, the second layer of polycrystalline diamond material exhibits a second wear resistance lower than the first wear resistance, and the third layer of polycrystalline diamond material exhibits a third wear resistance higher than the second wear resistance.

In yet further embodiments, the present invention includes cutting elements for use in earth-boring tools, which cutting elements comprise a cutting element substrate, a first layer of polycrystalline diamond material over a surface of the cutting element substrate, a second layer of polycrystalline diamond material on a side of the first layer of polycrystalline diamond material opposite the cutting element substrate, and a third layer of polycrystalline diamond material on a side of the second layer of polycrystalline material opposite the first layer of polycrystalline diamond material. The first layer of polycrystalline diamond material exhibits a first wear resistance, the second layer of polycrystalline diamond material exhibits a second wear resistance higher than the first wear resistance, and the third layer of polycrystalline diamond material exhibits a third wear resistance lower than the second wear resistance.

In additional embodiments, the present invention includes earth-boring tools comprising at least one cutting element as described herein.

Further embodiments of the present invention include methods of forming cutting elements for use in earth-boring tools. A cutting element comprising a diamond table on a substrate may be selectively designed and configured to form a shear lip at a wear scar on the cutting element after the cutting element is partially worn upon cutting a formation with the cutting element.

In some embodiments, a first layer of polycrystalline diamond material is formed over a surface of a cutting element substrate, and the first layer of polycrystalline diamond material is formulated to exhibit a first wear resistance. A second layer of polycrystalline diamond material is formed on a side of the first layer of polycrystalline diamond material opposite the cutting element substrate, and the second layer of polycrystalline diamond material is formulated to exhibit a second wear resistance higher than the first wear resistance.

In additional embodiments, a first layer of polycrystalline diamond material is formed over a surface of the cutting element substrate, and the first layer of polycrystalline diamond material is formulated to exhibit a first wear resistance. A second layer of polycrystalline diamond material is formed on a side of the first layer of polycrystalline diamond material opposite the cutting element substrate, and the second layer of polycrystalline diamond material is formulated to exhibit a second wear resistance lower than the first wear resistance. A third layer of polycrystalline diamond material is formed on a side of the second layer of polycrystalline material opposite the first layer of polycrystalline diamond material, and the third layer of polycrystalline diamond material is formulated to exhibit a third wear resistance higher than the second wear resistance.

In additional embodiments, a first layer of polycrystalline diamond material is formed over a surface of the cutting element substrate, and the first layer of polycrystalline diamond material is formulated to exhibit a first wear resistance. A second layer of polycrystalline diamond material is formed on a side of the first layer of polycrystalline diamond material opposite the cutting element substrate, and the second layer of polycrystalline diamond material is formulated to exhibit a second wear resistance higher than the first wear resistance. A third layer of polycrystalline diamond material is formed on a side of the second layer of polycrystalline material opposite the first layer of polycrystalline diamond material, and the third layer of polycrystalline diamond material is formulated to exhibit a third wear resistance lower than the second wear resistance.

In yet further embodiments of the present invention, methods of cutting an earth formation using an earth-boring tool comprise cutting the formation with a cutting element on the earth-boring tool, generating a shear lip at a wear scar on the cutting element upon cutting the formation with the cutting element, and at least substantially maintaining the shear lip on the wear scar for a usable life of the cutting element. The cutting element may be configured such that the shear lip comprises a volume of diamond material in a diamond table on a substrate of the cutting element.

BRIEF DESCRIPTION OF THE SEVERAL VIEWS OF THE DRAWINGS

While the specification concludes with claims particularly pointing out and distinctly claiming what are regarded as embodiments of the present invention, the advantages of embodiments of the invention may be more readily ascertained from the description of some embodiments of the invention when read in conjunction with the accompanying drawings, in which:

DETAILED DESCRIPTION

Figure 1:
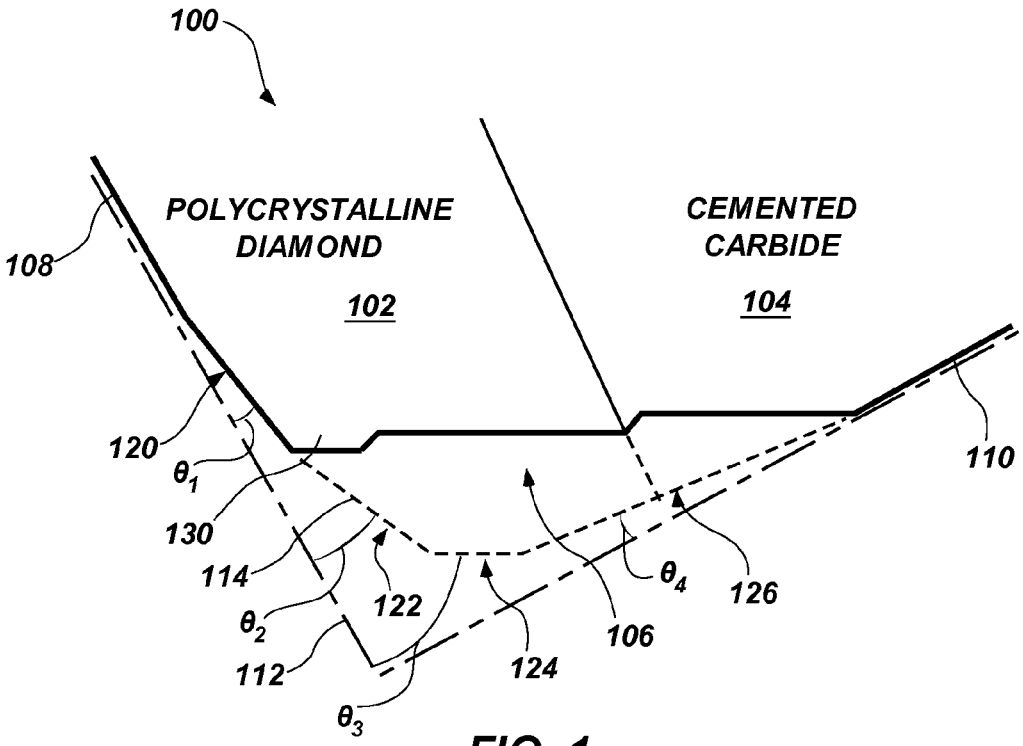
FIG. 1 is a schematic, partial cross-sectional view of a partially worn cutting element according to some embodiments of the present invention.

Some of the illustrations presented herein are not meant to be actual views of any particular cutting element or earth-boring tool, but are merely idealized representations that are employed to describe the present invention. Additionally, elements common between figures may retain the same numerical designation.

As used herein, the term "front surface" of a cutting element means and includes the generally planar end surface of a cutting element at what would be the leading end of the cutting element when the cutting element is mounted to a drilling tool and rotated about a rotational axis of the tool within a wellbore (the "rotationally leading" end of the cutting element). The front surface of a cutting element may comprise a major, exposed surface of a diamond table on the cutting element and may also be referred to as the "cutting face" of the cutting element.

As used herein, the term "lateral surface" of a cutting element means and includes the one or more lateral side surfaces of a cutting element that extend between the rotationally leading end of the cutting element and what would be the trailing end of the cutting element when the cutting element is mounted to a drilling tool and rotated about a rotational axis of the tool within a wellbore (the "rotationally trailing" end of the cutting element). Often, the lateral surface of a cutting element may comprise a single, generally cylindrical surface of the cutting element and include a lateral side surface of the diamond table of the cutting element as well as a lateral side surface of the substrate.

As used herein, the term "chamfer" means and includes any surface proximate an edge between a front surface of a cutting element and a lateral surface of a cutting element that is oriented at an acute angle to at least one of the front surface of the cutting element and the lateral surface of the cutting element. The chamfer is generally located between the front surface and lateral side surface of the diamond table of the cutting element.

As used herein, the term "leading chamfer" means and includes any chamfer of a cutting element that is oriented at an acute angle of between about five degrees (5°) and about thirty degrees (30°) to the front surface of the cutting element, and that extends to the front surface of the cutting element.

As used herein, the term "trailing chamfer" means and includes any chamfer of a cutting element that is oriented at an acute angle of between about five degrees (5°) and about thirty degrees (30°) to a line tangent to the lateral surface of the cutting element and parallel to a longitudinal axis of the cutting element, and that extends to the lateral surface of the cutting element.

As used herein, the term "landing chamfer" means and includes any chamfer that is oriented at an acute angle of between about forty degrees (40°) and about seventy degrees (70°) to the front surface of the cutting element.

As used herein, the term "break-in chamfer" means and includes any chamfer that is oriented at an acute angle of between about thirty degrees (30°) and about forty degrees (40°) to the front surface of the cutting element, and that extends to at least one of the front surface of a cutting element and a leading chamfer of a cutting element.

In some embodiments, cutting elements may be selectively designed and/or configured to result in the formation of a relatively short, thin, and durable shear lip within the diamond portion of the wear scar as the diamond table is used to cut formation material. In some embodiments, cutting elements are selectively designed and configured to comprise multiple chamfers that result in the formation of a shear lip at the wear scar as the cutting element wears during cutting. In additional embodiments, cutting elements are selectively designed and configured to comprise a multi-layer diamond table, and the layers are fabricated in such a manner as to result in the formation of a shear lip at the wear scar as the cutting element wears during cutting. In further embodiments, cutting elements are selectively designed and configured to comprise both multiple chamfers, as well as leached or "matrix free" regions in diamond tables of the cutting elements, such that a shear lip forms at the wear scar during cutting. These different aspects of the present invention are discussed in further detail below.

Cutting elements may comprise multiple chamfers that result in the formation of a shear lip at the wear scar as the cutting element wears during cutting. By way of example and not limitation, the cutting elements may comprise multiple chamfers as disclosed in International Publication Number WO 2008/102324 A1 (International Application Number PCT/IB2008/050649), which was published Aug. 28, 2008, the entire disclosure of which is incorporated herein by this reference. The chamfer surfaces may ameliorate chipping of the diamond table of the cutting element at the leading edge of the wear scar as the wear scar develops.

FIG. 1 is a cross-sectional view of an embodiment of a cutting element 100 of the present invention. The cutting element 100 includes a diamond table 102 on a cemented carbide substrate 104. In some embodiments, the diamond table 102 may have an average thickness of at least about one and a half (1.5) millimeters, at least about three (3) millimeters, or even at least about four (4) millimeters. The cutting element 100 is shown in FIG. 1 in a partially worn state, such that a wear scar 106 has formed at an edge of the cutting element 100 defined between a front surface 108 of the cutting element 100 and a lateral surface 110 of the cutting element 100. The dashed line 112 in FIG. 1 illustrates an initial boundary of the cutting element 100 after fabrication of the diamond table 102 on the cemented carbide substrate 104, or after attachment of the diamond table 102 to the cemented carbide substrate 104, and prior to the formation of chamfer surfaces on the cutting element 100. The cutting element 100 after fabrication, and prior to use in cutting a formation, may comprise a plurality of chamfers. The dashed line 114 in FIG. 1 illustrates a boundary of the cutting element 100 after the formation of chamfers on the cutting element 100, and prior to use of the cutting element 100 in cutting a formation (prior to formation of the wear scar 106). As shown in FIG. 1, the cutting element 100 may comprise a leading chamfer 120, a break-in chamfer 122, a landing chamfer 124, and a trailing chamfer 126.

As one non-limiting example, the leading chamfer 120 may be oriented at an acute angle $\theta_1$ of about twenty degrees (20°) to the front surface 108 of the cutting element 100, the break-in chamfer 122 may be oriented at an acute angle $\theta_2$ of about thirty degrees (30°) to the front surface 108 of the cutting element 100, the landing chamfer 124 may be oriented at an acute angle $\theta_3$ of about forty-five degrees (45°) to the front surface 108 of the cutting element 100, and the trailing chamfer 126 may be oriented at an acute angle $\theta_4$ of about twenty degrees (20°) to a line tangent to the lateral surface 110 of the cutting element 100 and parallel to the longitudinal axis of the cutting element 100.

The length (or width) of the chamfer is the largest distance between the major edges of the chamfer. In some embodiments, the leading chamfer 120 may have a length that is greater than a length of the break-in chamfer 122.

The presence of the leading chamfer 120 may be significant to establishing a shear lip 130 at the wear scar 106 of the cutting element 100 during wear. Therefore, in additional embodiments, the cutting element 100 may comprise only a leading chamfer 120, and may not include any of a break-in chamfer 122, a landing chamfer 124, and a trailing chamfer 126. In further embodiments, the cutting element 100 may comprise a leading chamfer 120 and a break-in chamfer 122, and may not include a landing chamfer 124 or a trailing chamfer 126. In further embodiments, the cutting element 100 may comprise a leading chamfer 120 and a landing chamfer 124, and may not include a break-in chamfer 122 or a trailing chamfer 126.

Furthermore, the diamond table 102 of the cutting element 100 may comprise polycrystalline diamond material and may exhibit relatively high strength and relatively high wear resistance. By way of example and not limitation, the diamond table 102 of the cutting element 100 may comprise a relatively high strength and high wear resistance polycrystalline diamond material as disclosed in U.S. Pat. No. 7,575,805 to Achilles et al., which issued Aug. 18, 2009, the entire disclosure of which is incorporated herein by this reference.

The polycrystalline diamond material may comprise a plurality of diamond grains bonded directly to one another by diamond-to-diamond bonds (i.e., interbonded diamond grains). The interstitial spaces between the interbonded diamond grains may comprise another material such as, for example, a metal catalyst material used to catalyze formation of the diamond-to-diamond bonds between the diamond grains, or they may be substantially free of any solid or liquid material.

The interstitial spaces between the interbonded diamond grains, which may comprise the metal catalyst material, may be homogeneously distributed through the diamond table 102, and may be of a fine scale.

The distribution of the interstitial spaces between the interbonded diamond grains may be characterized by the mean free path within the interstitial spaces. In some embodiments, the average mean free path within the interstitial spaces between the interbonded diamond grains may be about 6 μm or less, about 4.5 μm or less, or even about 3 μm or less.

In addition, the standard deviation of the mean free path within the interstitial spaces between the interbonded diamond grains, expressed as a percentage of the average mean free path, may be less than 80%, less than 70%, or even less than 60%.

The interbonded diamond grains in the diamond table 102 may have an average grain size that is about fifteen (15) microns or less, or even about eleven (11) microns or less.

The average grain size in a polycrystalline diamond material may be determined using image analysis techniques on a magnified image of the microstructure of the polycrystalline diamond material, as is known in the art. Images of the microstructure may be acquired using, for example, a scanning electron microscope, and these images may be analyzed using known image analysis techniques to measure an average size of a number of grains in the microstructure and, thus, determine the average grain size of the grains in the polycrystalline diamond material.

The interbonded diamond grains in the diamond table 102 may have a multi-modal grain size distribution, and may be formed from diamond particles having three or more (tri-modal), or even five or more (penta-modal) different groups of diamond particles (grains) each having a different average particle size. For example, in one non-limiting example, the interbonded diamond grains in the diamond table may have different size groups of diamond grains (a penta-modal grain size distribution), each having an average grain size as shown in Table 1 below.

TABLE 1

| Group | Average Grain Size (in microns) | Percent of Total Diamond Grains (by Mass) |
|---|---|---|
| 1 | 20 to 25 | 25 to 30 |
| 2 | 10 to 15 | 40 to 50 |
| 3 | 5 to 8 | 5 to 10 |
| 4 | 3 to 5 | 15 to 20 |
| 5 | Less than 4 | Less than 8 |

By forming the diamond table 102 to comprise interbonded diamond grains having a multi-modal grain size distribution, the total volume percent of diamond in the diamond table 102 may be increased. For example, in some embodiments, the diamond table 102 may comprise at least about eighty-eight volume percent (88 vol %) diamond, or even at least ninety volume percent (90 vol %) diamond.

Due to the above-described characteristics of the diamond table 102, the diamond table 102 may exhibit a high wear resistance relative to other diamond tables commonly used in the art.

In this configuration, when the cutting element 100 is used to cut a formation, and the wear scar 106 forms on the cutting element 100, tri-axial compression may be generated in the volume of the diamond table 102 proximate the wear scar 106 at the rotationally leading end of the wear scar 106 (the end proximate the front surface 108 of the cutting element 100), and tension may be generated in the volume of the diamond table 102 and/or the cemented carbide substrate 104 proximate the wear scar 106 at the rotationally trailing end of the wear scar 106. Furthermore, thermal energy within the diamond table 102 generated by the cutting action of the cutting element 100 may work together with the compression in the volume of the diamond table 102 proximate the rotationally leading end of the wear scar 106 to cause plastic deformation and work hardening of this portion of the diamond table 102. These factors, together with differences in wear mechanisms between the leading end of the wear scar 106 and the trailing end of the wear scar 106, may lead to the portion of the cutting element 100 proximate the trailing end of the wear scar 106 wearing away at a relatively faster rate compared to the portion of the cutting element 100 proximate the leading end of the wear scar 106, and the formation of a shear lip 130 in the diamond table 102 at the wear scar 106.

Multiple chamfers may be provided on the cutting element 100, as previously discussed, to cause a volume of the cutting element 100 at the leading end of the wear scar 106 formed on the cutting element 100 during cutting to be subjected to compressive stress and a volume of the cutting element 100 at the trailing end of the wear scar 106 to be subjected to tensile stress. The volume of the cutting element 100 at the leading end of the wear scar 106 in compression may comprise diamond material, and the volume of the cutting element 100 at the trailing end of the wear scar 106 in tension may comprise at least some cemented carbide material. Furthermore, the multiple chamfers provided on the cutting element 100 may result in generation of tri-axial compression in the volume of the cutting element 100 at the leading end of the wear scar 106. This state of tri-axial compression may persist within the volume of the cutting element 100 at the leading end of the wear scar 106 throughout the usable life of the cutting element 100. The thermal energy within the volume of the cutting element 100 at the leading end of the wear scar 106 resulting from heat generated by the cutting action of the cutting element 100, together with the state of compression therein, may lead to plastic deformation and work hardening of the diamond material in the volume of the cutting element 100 at the leading end of the wear scar 106.

Thus configured, the volume of the cemented carbide material at the trailing end of the wear scar 106 may wear at a relatively faster rate relative to the volume of diamond material at the leading end of the wear scar 106. As a result, the portion of the diamond material at the rear (rotationally trailing end) of the diamond table 102 immediately in front of the cemented carbide substrate 104 may become unsupported as the cemented carbide material behind the diamond table 102 wears away, which may lead to chipping and breaking away of this rotationally trailing portion of the diamond table 102, and the formation of a shear lip 130 in the diamond portion of the wear scar 106. The shear lip 130 may comprise a work-hardened portion of the diamond table 102 at the wear scar 106.

Furthermore, it is noted that the wear mechanism at the trailing end of the wear scar 106 is a two-body wear mechanism, the two bodies being the cutting element 100 and the formation, while the wear mechanism at the trailing end of the wear scar 106 is a three-body wear mechanism, the third body being formation cuttings and detritus generated by the cutting action of the cutting element 100 that is disposed between the formation and the cutting element 100. The difference between the two-body wear mechanism and the three-body wear mechanism may contribute to a relatively higher wear rate at the trailing end of the wear scar 106, and a relatively lower wear rate at the leading end of the wear scar 106, and, hence, to the formation of a shear lip 130 in the diamond portion of the wear scar 106.

Figure 2:
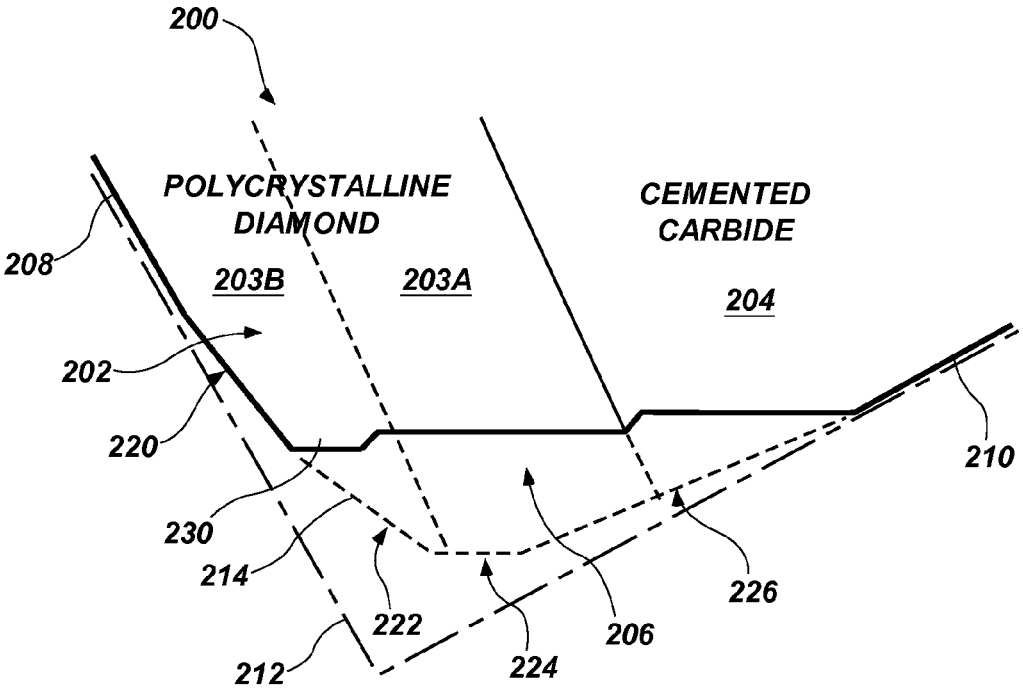
FIG. 2 is a schematic, partial cross-sectional view of another partially worn cutting element according to additional embodiments of the present invention.

Cutting elements may comprise multi-layer diamond tables that result in the formation of a shear lip at the wear scar as the cutting element wears during cutting. FIG. 2 is a cross-sectional view of another embodiment of a cutting element 200 of the present invention. The cutting element 200 includes a multi-layer diamond table 202 on a cemented carbide substrate 204. In some embodiments, the multi-layer diamond table 202 may have an average thickness of at least about one and a half (1.5) millimeters, at least about three (3) millimeters, or even at least about four (4) millimeters. The multi-layer diamond table 202 of FIG. 2 includes a first layer 203A and a second layer 203B. As discussed in further detail below, the first layer 203A may wear at a relatively faster rate compared to the second layer 203B when the cutting element 200 is used to cut a formation.

The cutting element 200 is shown in FIG. 2 in a partially worn state, such that a wear scar 206 has formed at an edge of the cutting element 200 defined between a front surface 208 of the cutting element 200 and a lateral surface 210 of the cutting element 200. The dashed line 212 in FIG. 2 illustrates an initial boundary of the cutting element 200 after fabrication of the diamond table 202 on the cemented carbide substrate 204, or after attachment of the diamond table 202 to the cemented carbide substrate 204, and prior to the formation of any optional chamfer surfaces on the cutting element 200. The cutting element 200 after fabrication, and prior to use in cutting a formation, optionally may comprise a plurality of chamfers, as previously described herein in relation to the cutting element 100 illustrated in FIG. 1. The dashed line 214 in FIG. 2 illustrates a boundary of the cutting element 200 after the formation of chamfers on the cutting element 200, and prior to use of the cutting element 200 in cutting a formation (prior to formation of the wear scar 106). As shown in FIG. 2, the cutting element 200 may comprise, for example, a leading chamfer 220, a break-in chamfer 222, a landing chamfer 224, and a trailing chamfer 226, such as those previously described in relation to the cutting element 100 of FIG. 1.

Each of the first layer 203A and the second layer 203B of the diamond table 202 may comprise a polycrystalline diamond material that includes a plurality of interbonded diamond grains. The interstitial spaces between the interbonded diamond grains may comprise another material such as, for example, a metal catalyst material used to catalyze formation of the diamond-to-diamond bonds between the diamond grains, or they may be substantially free of any solid or liquid material.

The first layer 203A of the diamond table 202 may have a material composition that differs from a material composition of the second layer 203B of the diamond table 202. The difference in composition between the first layer 203A and the second layer 203B may at least partially cause the first layer 203A of the diamond table 202 to wear at a fast rate at the wear scar 206 than the second layer 203B of the diamond table 202, and, thus, may result in the formation of a shear lip 230 at the wear scar 206 during wear of the cutting element 200.

In some embodiments, the second layer 203B of the diamond table 202 may exhibit a strength that is between about 103% and about 115% of a strength exhibited by the first layer 203A of the diamond table 202. Furthermore, in some embodiments, the second layer 203B of the diamond table 202 may exhibit a wear resistance that is at least about 105% of a wear resistance exhibited by the first layer 203A of the diamond table 202. More particularly, the second layer 203B of the diamond table 202 may exhibit a wear resistance that is between about 110% and about 200% of a wear resistance exhibited by the first layer 203A of the diamond table 202, or even more particularly, between about 130% and about 170% of a wear resistance exhibited by the first layer 203A of the diamond table 202.

In some embodiments, the second layer 203B of the diamond table 202 may have a higher diamond content by volume than the first layer 203A of the diamond table 202. For example, the second layer 203B of the diamond table 202 may have a diamond volume percentage that is between about 103% and about 110% of the diamond volume percentage in the first layer 203A of the diamond table 202. For example, the second layer 203B of the diamond table 202 may comprise at least about ninety volume percent (90 vol %) diamond, and the first layer 203A of the diamond table 202 may comprise between about eighty volume percent (80 vol %) and about eighty-eight volume percent (88 vol %) diamond. In such embodiments, the first layer 203A and the second layer 203B may have the same or different average grain sizes.

In additional embodiments, the second layer 203B of the diamond table 202 may comprise a catalyst matrix material disposed in interstitial spaces between the interbonded diamond grains that is different from a catalyst matrix material disposed in interstitial spaces between the interbonded diamond grains in the first layer 203A of the diamond table 202.

The composition of the catalyst matrix material in each of the first layer 203A and the second layer 203B may be selected in such a manner as to cause the first layer 203A to exhibit a wear rate that is higher than a wear rate exhibited by the second layer 203B, such that a shear lip 230 forms at the wear scar 206 during wear of the cutting element 200. As a non-limiting example, the catalyst matrix material in the second layer 203B of the diamond table 202 may comprise cobalt or a cobalt-based alloy, and the catalyst matrix material in the first layer 203A of the diamond table 202 may comprise nickel or a nickel-based alloy.

In additional embodiments, the second layer 203B of the diamond table 202 may comprise interbonded diamond grains having an average grain size that is different than an average grain size of interbonded diamond grains in the first layer 203A of the diamond table 202. The average grain size of the interbonded diamond grains in each of the first layer 203A and the second layer 203B of the diamond table 202 may be selected in such a manner as to cause the first layer 203A to exhibit a wear rate that is higher than a wear rate exhibited by the second layer 203B, such that a shear lip 230 forms at the wear scar 206 during wear of the cutting element 200. For example, the second layer 203B of the diamond table 202 may comprise interbonded diamond grains having an average grain size that is less than an average grain size of interbonded diamond grains in the first layer 203A of the diamond table 202. In some embodiments, the interbonded diamond grains in the second layer 203B of the diamond table 202 may have an average grain size that is about forty percent (40%) or less of the average grain size of the interbonded diamond grains in the first layer 203A of the diamond table 202. As a non-limiting example, the interbonded diamond grains in the second layer 203B of the diamond table 202 may have an average grain size that is about six (6) microns or less, and the interbonded diamond grains in the first layer 203A of the diamond table 202 may have an average grain size that is about ten (10) microns or more. One or both of the first layer 203A and the second layer 203B of the diamond table 202 may have a multi-modal grain size distribution, as previously described herein.

Figure 3:
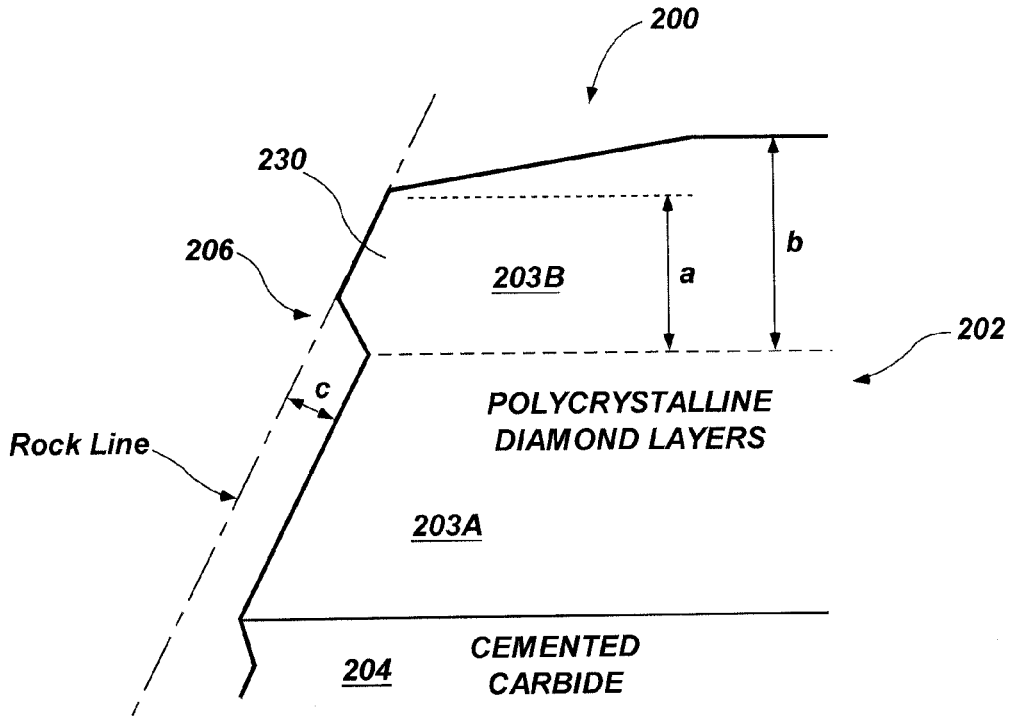
FIG. 3 is another view of the partially worn cutting element of FIG. 2.

FIG. 3 is a schematic diagram of the partially worn cutting element 200 of FIG. 2, but rotated clockwise by about 135°. FIG. 3 illustrates a rock line (a dashed line), which represents the surface of a rock formation being cut by the cutting element 200. In some embodiments, the dimension b, which is an average thickness of the second layer 203B of the diamond table 202 prior to chamfering, may be sufficiently thick to at least substantially prevent the shear lip 230 from shearing off from (breaking away from) the cutting element 200 during cutting. The higher the strength exhibited by the second layer 203B, the thinner the dimension b may be while still at least substantially preventing the shear lip 230 from shearing off of the cutting element 200. A thinner second layer 203B, however, may result in a thinner shear lip 230, the thickness of which is represented by dimension a in FIG. 3, and a thinner shear lip 230 may cut formation material relatively more efficiently compared to a thicker shear lip 230. The dimension c shown in FIG. 3 will be determined by the difference between the wear resistance of the first layer 203A and the wear resistance of the second layer 203B. If the first layer 203A exhibits a wear resistance that is too low, dimension c may become too large, and the shear lip 230 may shear off from the cutting element 200. For the shear lip 230 to function effectively, the dimension b need not be large.

Figure 4:
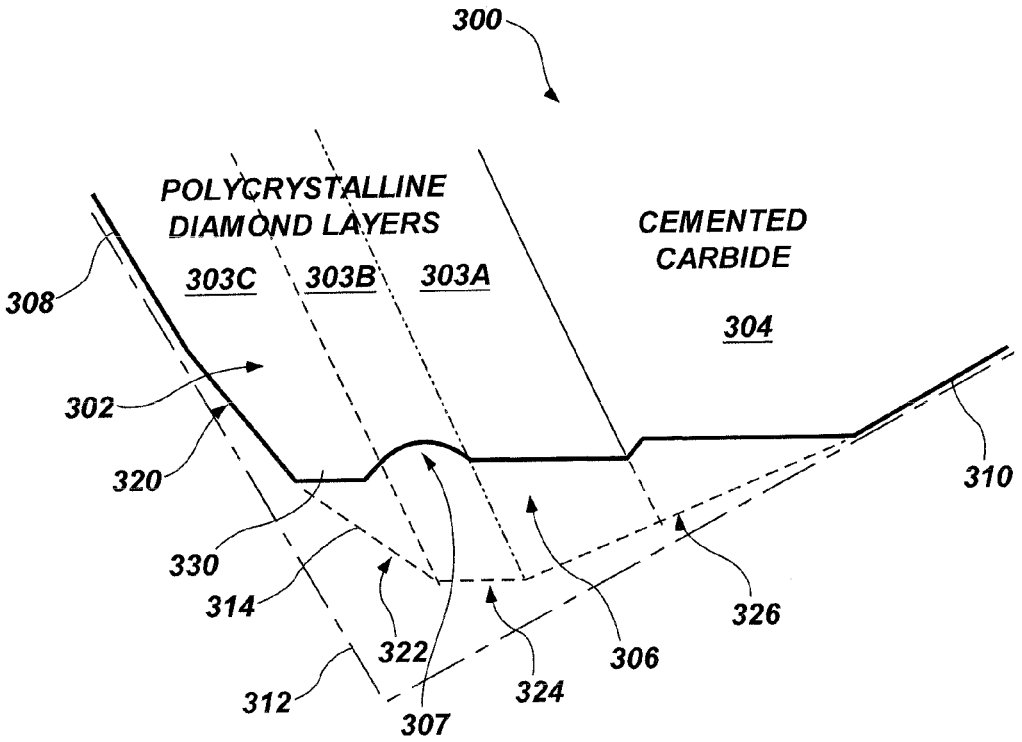
FIG. 4 is a schematic, partial cross-sectional view of another partially worn cutting element according to further embodiments of the present invention.

FIG. 4 is a cross-sectional view of another embodiment of a cutting element 300 of the present invention. The cutting element 300 includes a multi-layer diamond table 302 on a cemented carbide substrate 304. In some embodiments, the multi-layer diamond table 302 may have an average thickness of at least about one and a half (1.5) millimeters, or even at least about four (4) millimeters. The multi-layer diamond table 302 of FIG. 4 includes a first layer 303A, a second layer 303B, and a third layer 303C. As discussed in further detail below, the second layer 303B may wear at a relatively faster rate compared to the first layer 303A and the third layer 303C when the cutting element 300 is used to cut a formation.

The cutting element 300 is shown in FIG. 4 in a partially worn state, such that a wear scar 306 has formed at an edge of the cutting element 300 defined between a front surface 308 of the cutting element 300 and a lateral surface 310 of the cutting element 300. The dashed line 312 in FIG. 4 illustrates an initial boundary of the cutting element 300 after fabrication of the diamond table 302 on the cemented carbide substrate 304, or after attachment of the diamond table 302 to the cemented carbide substrate 304, and prior to the formation of any optional chamfer surfaces on the cutting element 300. The cutting element 300 after fabrication, and prior to use in cutting a formation, optionally may comprise a plurality of chamfers, as previously described herein in relation to the cutting element 100 of FIG. 1. The dashed line 314 in FIG. 4 illustrates a boundary of the cutting element 300 after the formation of chamfers on the cutting element 300, and prior to use of the cutting element 300 in cutting a formation (prior to formation of the wear scar 306). As shown in FIG. 4, the cutting element 300 may comprise, for example, a leading chamfer 320, a break-in chamfer 322, a landing chamfer 324, and a trailing chamfer 326, such as those previously described in relation to the cutting element 100 of FIG. 1.

Each of the first layer 303A, the second layer 303B, and the third layer 303C of the diamond table 302 may comprise a polycrystalline diamond material that includes a plurality of interbonded diamond grains. The interstitial spaces between the interbonded diamond grains may comprise another material such as, for example, a metal catalyst material used to catalyze formation of the diamond-to-diamond bonds between the diamond grain, or they may be substantially free of any solid or liquid material.

The second layer 303B of the diamond table 302 may have a material composition that differs from a material composition of at least one of the first layer 303A and the third layer 303C of the diamond table 302. The difference in composition between the second layer 303B and the first layer 303A and the third layer 303C may at least partially cause the second layer 303B of the diamond table 302 to wear at a faster rate at the wear scar 306 than the first layer 303A and the third layer 303C of the diamond table 302, and, thus, may result in the formation of a shear lip 330 at the wear scar 306, which comprises a portion of the third layer 303C, during wear of the cutting element 300.

In some embodiments, the third layer 303C of the diamond table 302 may exhibit a strength that is between about 103% and about 115% of a strength exhibited by the second layer 303B of the diamond table 302. Furthermore, in some embodiments, the third layer 303C of the diamond table 302 may exhibit a wear resistance that is at least about 105% of a wear resistance exhibited by the second layer 303B of the diamond table 302. More particularly, the third layer 303C of the diamond table 302 may exhibit a wear resistance that is between about 110% and about 200% of a wear resistance exhibited by the second layer 303B of the diamond table 302, or even more particularly, between about 130% and about 170% of a wear resistance exhibited by the second layer 303B of the diamond table 302.

In some embodiments, the first layer 303A may have a composition that is at least substantially identical to that of the third layer 303C, such that the first layer 303A exhibits at least substantially the same strength and wear resistance as does the third layer 303C. In other embodiments, the material composition of the first layer 303A may differ from a material composition of each of the second layer 303B and the third layer 303C in such a manner as to result in the first layer 303A exhibiting at least one of a strength and a wear resistance between the strengths and the wear resistances exhibited by the second layer 303B and the third layer 303C.

In some embodiments, the second layer 303B may have an average thickness that is less than an average thickness of at least one of the first layer 303A and the third layer 303C.

Thus configured, a recess 307 may form in the second layer 303B at the wear scar 306, which may serve to clearly define the rotationally trailing side of the shear lip 330, which comprises a portion of the first layer 303A.

In some embodiments, the first layer 303A and the third layer 303C of the diamond table 302 may have a higher diamond content by volume than the second layer 303B of the diamond table 302. For example, each of the first layer 303A and the third layer 303C of the diamond table 302 may have a diamond volume percentage that is between about 103% and about 110% of the diamond volume percentage in the second layer 303B of the diamond table 302. For example, each of the first layer 303A and the third layer 303C of the diamond table 302 may comprise at least about ninety volume percent (90 vol %) diamond, and the second layer 303B of the diamond table 302 may comprise between about eighty volume percent (80 vol %) and about eighty-eight volume percent (88 vol %) diamond.

In additional embodiments, the first layer 303A and the third layer 303C of the diamond table 302 may comprise a catalyst matrix material disposed in interstitial spaces between the interbonded diamond grains therein that is different that a catalyst matrix material disposed in interstitial spaces between the interbonded diamond grains in the second layer 303B of the diamond table 302. The composition of the catalyst matrix material in each of the first layer 303A, the second layer 303B, and the third layer 303C may be selected in such a manner as to cause the second layer 303B to exhibit a wear rate that is higher than a wear rate exhibited by each of the first layer 303A and the third layer 303C, such that a shear lip 330 forms at the wear scar 306 during wear of the cutting element 300. As a non-limiting example, the catalyst matrix material in each of the first layer 303A and the third layer 303C of the diamond table 302 may comprise cobalt or a cobalt-based alloy, and the catalyst matrix material in the second layer 303B of the diamond table 302 may comprise nickel or a nickel-based alloy.

In additional embodiments, each of the first layer 303A and the third layer 303C of the diamond table 302 may comprise interbonded diamond grains having an average grain size that differ from an average grain size of interbonded diamond grains in the second layer 303B of the diamond table 302. The average grain size of the interbonded diamond grains in each of the first layer 303A, the second layer 303B, and the third layer 303C of the diamond table 302 may be selected in such a manner as to cause the second layer 303B to exhibit a wear rate that is higher than wear rates exhibited by the first layer 303A and the third layer 303C, such that a shear lip 330 forms at the wear scar 306 during wear of the cutting element 300. For example, the first layer 303A and the third layer 303C of the diamond table 302 may comprise interbonded diamond grains having an average grain size that is less than an average grain size of interbonded diamond grains in the second layer 303B of the diamond table 302. In some embodiments, the interbonded diamond grains in the first layer 303A and the third layer 303C of the diamond table 302 may have an average grain size that is about forty percent (40%) or less of the average grain size of the interbonded diamond grains in the second layer 303B of the diamond table 302. As a non-limiting example, the interbonded diamond grains in the first layer 303A and the third layer 303C of the diamond table 302 may have an average grain size that is about six (6) microns or less, and the interbonded diamond grains in the second layer 303B of the diamond table 302 may have an average grain size that is about ten (10) microns or more. One or more of the first layer 303A, the second layer 303B, and the third layer 303C of the diamond table 302 may have a multi-modal grain size distribution, as previously described herein.

Figure 5:
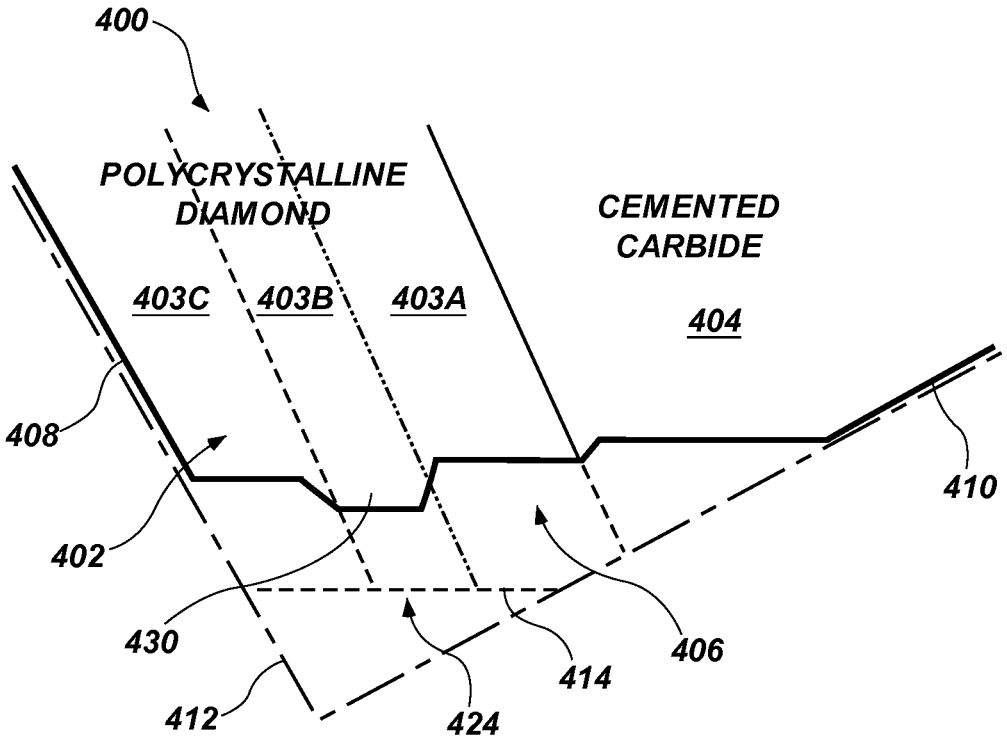
FIG. 5 is a schematic, partial cross-sectional view of another partially worn cutting element according to further embodiments of the present invention.

FIG. 5 is a cross-sectional view of another embodiment of a cutting element 400 of the present invention. The cutting element 400 includes a multi-layer diamond table 402 on a cemented carbide substrate 404. In some embodiments, the multi-layer diamond table 402 may have an average thickness of at least about one and a half (1.5) millimeters, at least about three (3) millimeters, or even at least about four (4) millimeters. The multi-layer diamond table 402 of FIG. 5 includes a first layer 403A, a second layer 403B, and a third layer 403C. As discussed in further detail below, the second layer 403B may wear at a relatively slower rate compared to the first layer 403A and the third layer 403C when the cutting element 400 is used to cut a formation.

The cutting element 400 is shown in FIG. 5 in a partially worn state, such that a wear scar 406 has formed at an edge of the cutting element 400 defined between a front surface 408 of the cutting element 400 and a lateral surface 410 of the cutting element 400. The dashed line 412 in FIG. 5 illustrates an initial boundary of the cutting element 400 after fabrication of the diamond table 402 on the cemented carbide substrate 404, or after attachment of the diamond table 402 to the cemented carbide substrate 404, and prior to the formation of any optional chamfer surface on the cutting element 400. The cutting element 400 after fabrication, and prior to use in cutting a formation, optionally may comprise a chamfer. The dashed line 414 in FIG. 5 illustrates a boundary of the cutting element 400 after the formation of a chamfer on the cutting element 400, and prior to use of the cutting element 400 in cutting a formation (prior to formation of the wear scar 406). As shown in FIG. 5, the cutting element 400 may comprise a break-in chamfer 424. In additional embodiments, the cutting element 400 may comprise one or more of a leading chamfer, a landing break-in chamfer, a landing chamfer, and a trailing chamfer, as previously described herein.

Each of the first layer 403A, the second layer 403B, and the third layer 403C of the diamond table 402 may comprise a polycrystalline diamond material that includes a plurality of interbonded diamond grains. The interstitial spaces between the interbonded diamond grains may comprise another material such as, for example, a metal catalyst material used to catalyze formation of the diamond-to-diamond bonds between the diamond grain, or they may be substantially free of any solid or liquid material. In other words, they may be leached or unleashed.

The second layer 403B of the diamond table 402 may have a material composition that differs from a material composition of at least one of the first layer 403A and the third layer 403C of the diamond table 402. The difference in composition between the second layer 403B and the first layer 403A and the third layer 403C may at least partially cause the second layer 403B of the diamond table 402 to wear at a slower rate at the wear scar 406 than the first layer 403A and the third layer 403C of the diamond table 402, and, thus, may result in the formation of a shear lip 430 at the wear scar 406, which comprises a portion of the second layer 403B, during wear of the cutting element 400.

In some embodiments, the second layer 403B of the diamond table 402 may exhibit a strength that is between about 103% and about 115% of a strength exhibited by each of the first layer 403A of the diamond table 402 and the third layer 403C of the diamond table 402. Furthermore, in some embodiments, the second layer 403B of the diamond table 402 may exhibit a wear resistance that is at least about 105% of a wear resistance exhibited by each of the first layer 403A of the diamond table 402 and the third layer 403C. More particularly, the second layer 403B of the diamond table 402 may exhibit a wear resistance that is between about 110% and about 200% of a wear resistance exhibited by each of the first layer 403A and the third layer 403C of the diamond table 402, or even more particularly, between about 130% and about 170% of a wear resistance exhibited by each of the first layer 403A and the third layer 403C of the diamond table 402.

In some embodiments, the first layer 403A may have a composition that is at least substantially identical to that of the third layer 403C, such that the first layer 403A exhibits at least substantially the same strength and wear resistance as does the third layer 403C. In other embodiments, the material composition of the third layer 403C may differ from a material composition of each of the first layer 403A and the second layer 403B in such a manner as to result in the third layer 403C exhibiting at least one of a strength and a wear resistance between the strengths and the wear resistances exhibited by the first layer 403A and the second layer 403B.

In some embodiments, the second layer 403B may have an average thickness that is less than an average thickness of at least one of the first layer 403A and the third layer 403C.

In some embodiments, the first layer 403A and the third layer 403C of the diamond table 402 may have a lower diamond content by volume than the second layer 403B of the diamond table 402. For example, the second layer 403B may have a diamond volume percentage that is between about 103% and about 110% of the diamond volume percentage in each of the first layer 403A and the third layer 403C of the diamond table 402, respectively. For example, the second layer 403B of the diamond table 402 may comprise at least about ninety volume percent (90 vol %) diamond, and each of the first layer 403A and the third layer 403C of the diamond table 402 may comprise between about eighty volume percent (80 vol %) and about eighty-eight volume percent (88 vol %) diamond.

In additional embodiments, the first layer 403A and the third layer 403C of the diamond table 402 may comprise a catalyst matrix material disposed in interstitial spaces between the interbonded diamond grains therein that is different that a catalyst matrix material disposed in interstitial spaces between the interbonded diamond grains in the second layer 403B of the diamond table 402. The composition of the catalyst matrix material in each of the first layer 403A, the second layer 403B, and the third layer 403C may be selected in such a manner as to cause the second layer 403B to exhibit a wear rate that is lower than a wear rate exhibited by each of the first layer 403A and the third layer 403C, such that a shear lip 430 forms at the wear scar 406 during wear of the cutting element 400. As a non-limiting example, the catalyst matrix material in each of the first layer 403A and the third layer 403C of the diamond table 402 may comprise nickel or a nickel-based alloy, and the catalyst matrix material in the second layer 403B of the diamond table 402 may comprise cobalt or a cobalt-based alloy.

In additional embodiments, each of the first layer 403A and the third layer 403C of the diamond table 402 may comprise interbonded diamond grains having an average grain size that differ from an average grain size of interbonded diamond grains in the second layer 403B of the diamond table 402. The average grain size of the interbonded diamond grains in each of the first layer 403A, the second layer 403B, and the third layer 403C of the diamond table 402, respectively, may be selected in such a manner as to cause the second layer 403B to exhibit a wear rate that is higher than wear rates exhibited by the first layer 403A and the third layer 403C, such that a shear lip 430 forms at the wear scar 406 during wear of the cutting element 400. For example, the first layer 403A and the third layer 403C of the diamond table 402 may comprise interbonded diamond grains having an average grain size that is greater than an average grain size of interbonded diamond grains in the second layer 403B of the diamond table 402. In some embodiments, the interbonded diamond grains in the second layer 403B of the diamond table 402 may have an average grain size that is about forty percent (40%) or less of the average grain size of the interbonded diamond grains in each of the first layer 403A and the third layer 403C of the diamond table 402, respectively. As a non-limiting example, the interbonded diamond grains in the first layer 403A and the third layer 403C of the diamond table 402 may have an average grain size that is about ten (10) microns or more, and the interbonded diamond grains in the second layer 403B of the diamond table 402 may have an average grain size that is about six (6) microns or less. One or more of the first layer 403A, the second layer 403B, and the third layer 403C of the diamond table 402 may have a multi-modal grain size distribution, as previously described herein.

Additional embodiments of the present invention include methods of forming cutting elements having multi-layered diamond tables, such as the cutting elements 200, 300, and 400 previously described herein.

The multi-layer diamond tables may be formed using high temperature/high pressure (HTHP) processes. In some embodiments, the diamond tables may be formed on a cutting element substrate, or the diamond tables may be formed separately from any cutting element substrate and later attached to a cutting element substrate.

In some embodiments, one or more pre-formed, less than fully sintered (e.g., "green" or "brown") discs or other bodies may be used to form a multi-layered diamond table. Each less than fully sintered disc may comprise a plurality of diamond grains. The diamond grains in each disc may be unsintered, such that they are not bonded to one another, or they may be partially sintered, such that they are partially bonded to one another. The less than fully sintered discs may be porous.

Each less than fully sintered disc optionally may comprise a catalyst matrix material therein. In some embodiments, the catalyst matrix material may be present in the discs in the form of particles of the catalyst matrix material. In additional embodiments, the catalyst matrix material may be present in the discs in the form of an at least substantially continuous matrix in which the diamond grains are embedded.

Less than fully sintered discs may be formed by pressing (axially or isostatically) a particulate material in a mold or die to form a green, unsintered disc. Less than fully sintered discs also may be formed by tape casting, for example. The particulate material comprises diamond grains, and, optionally, may also comprise particles of catalyst matrix material and/or an organic binder material. Optionally, after pressing, the green, unsintered disc may be partially sintered to form a brown disc. Thus formed, the less than fully sintered discs are solid three-dimensional bodies, although they may be relatively fragile.

The less than fully sintered discs may be provided in a container. The container may include one or more generally cup-shaped members that may be assembled and swaged and/or welded together to form the container. The container may have circular end walls and a generally cylindrical lateral side wall extending perpendicularly between the circular end walls, such that the container is a closed cylinder.

A cutting element substrate also may be provided within the container, and the discs may be stacked over a surface (e.g., a generally planar, circular end surface of a cylindrical cutting element substrate).

To catalyze the formation of inter-granular bonds between the diamond grains in the less than fully sintered discs during an HTHP process, the diamond grains in the discs may be physically exposed to catalyst material during the HTHP process. In other words, catalyst material may be provided in each of the discs prior to commencing the HTHP process, or catalyst material may be allowed or caused to migrate into each of the discs from one or more sources of catalyst material during the HTHP process.

For example, the discs optionally may include particles comprising a catalyst material (such as, for example, the cobalt in cobalt-cemented tungsten carbide). However, if the cutting element substrate includes a catalyst material, the catalyst material may be swept from the surface of the substrate into one or more of the discs during sintering and catalyze the formation of inter-granular diamond bonds between the diamond grains in the discs. In such instances, it may not be necessary or desirable to include particles of catalyst material in the discs prior to the sintering process.

After providing the discs within the container, the assembly optionally may be subjected to a cold pressing process to compact the discs (and, optionally, a cutting element substrate) in the container.

The resulting assembly then may be sintered in an HTHP process in accordance with procedures known in the art to form a cutting element having a multi-layered diamond table like the diamond tables 202, 302, 402 previously described herein. Each disc may be used to form a single layer in the multi-layer diamond table. Furthermore, one or more layers in the diamond table may be formed using a powder comprising diamond grains instead of a solid, pre-formed disc. Furthermore, in some embodiments, one or more of the pre-formed discs may be fully sintered in an HTHP process prior to sintering additional discs thereto in an additional HTHP process.

Although the exact operating parameters of HTHP processes will vary depending on the particular compositions and quantities of the various materials being sintered, the pressures in the heated press may be greater than about five gigapascals (5.0 GPa) and the temperatures may be greater than about fifteen hundred degrees Celsius (1,500° C.). Furthermore, the materials being sintered may be held at such temperatures and pressures for between about thirty seconds (30 sec) and about twenty minutes (20 min).

Figure 6C:
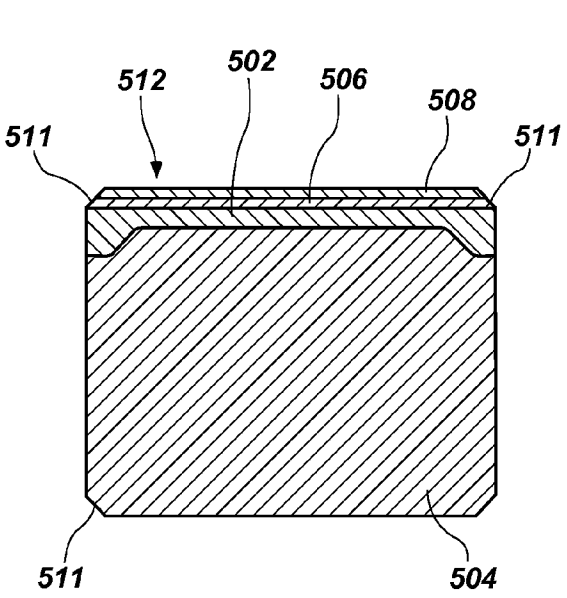
FIGS. 6A through 6C illustrate an embodiment of a method of the present invention that may be used to form a multi-layer diamond table.
Figure 6B:
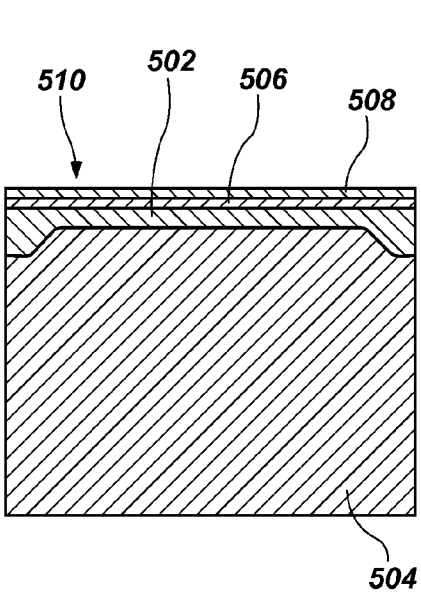
Figure 6A:
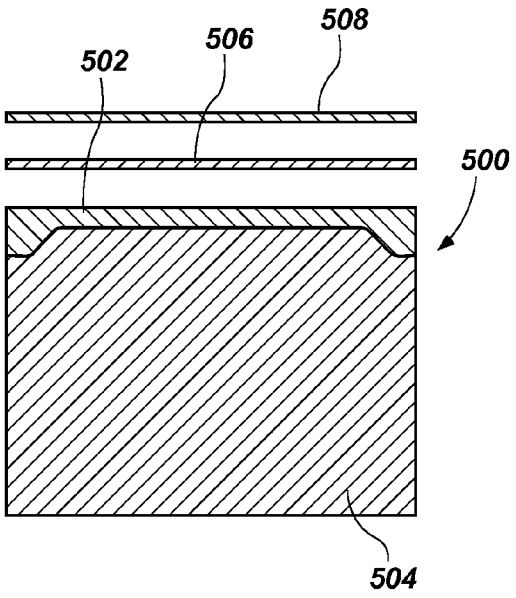

FIGS. 6A through 6C illustrate one example embodiment of a method of the present invention. As shown in FIG. 6A, a first presintered cutting element 500 may be formed that comprises a single layer polycrystalline diamond table 502 having a first wear resistance. The diamond table 502 may be at least substantially fully sintered and disposed on a cutting element substrate 504. A relatively thin (e.g., tape-cast) non-sintered (green) layer 506 comprising diamond grains may be applied to a surface of the diamond table 502 opposite the cutting element substrate 504. The layer 506 may be formulated to form a layer of polycrystalline diamond material that exhibits a different (e.g., higher or lower) wear resistance compared to the diamond table 502 upon sintering in an HTHP process. Optionally, one or more additional non-sintered (green) layers 508 (which may have a different composition from the first layer 506) comprising diamond grains may be applied over the first layer 506 to form an intermediate structure, which then may be sintered in an HTHP process as previously described herein to form a cutting element 510 shown in FIG. 6B. After forming the cutting element 510 shown in FIG. 6B, one or more chamfer surfaces 511 may be formed on the cutting element 510 to form a chamfered cutting element 512 shown in FIG. 6C. In additional embodiments, an HTHP sintering process may be used to sinter the first layer 506 to the cutting element 500 of FIG. 6A, after which an additional sintering process may be used to sinter the second layer 508 to a layer of polycrystalline diamond formed from the first layer 506.

Figure 7C:
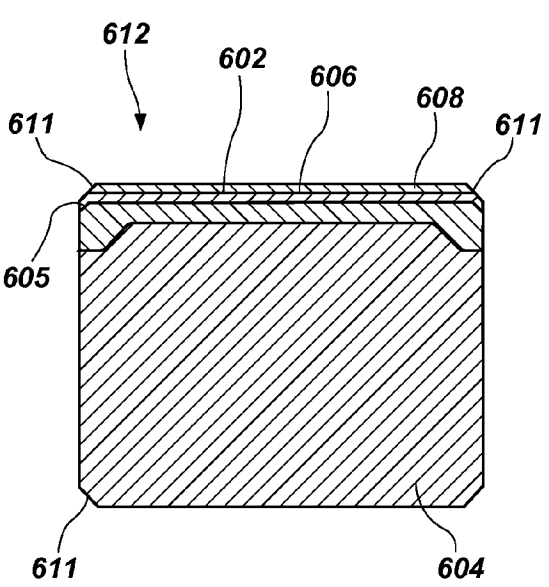
FIGS. 7A through 7C illustrate another embodiment of a method of the present invention that may be used to form a multi-layer diamond table.
Figure 7B:
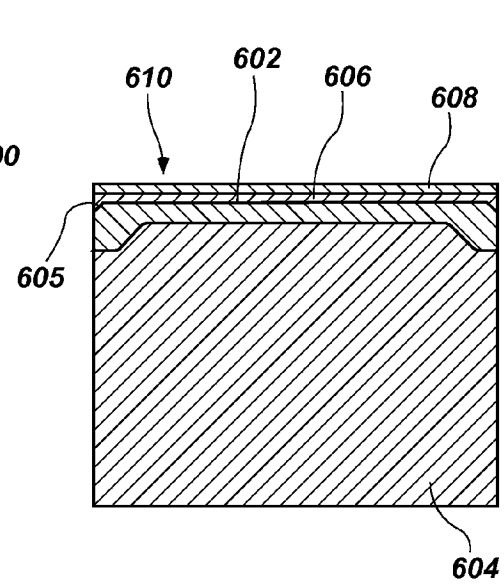
Figure 7A:
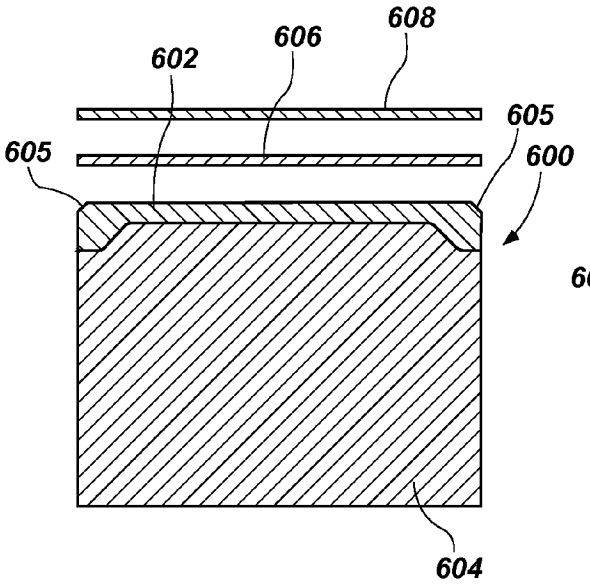

FIGS. 7A through 7C illustrate yet another embodiment of a method of the present invention. As shown in FIG. 7A, a first presintered cutting element 600 may be formed that comprises a single layer polycrystalline diamond table 602 having a first wear resistance. The diamond table 602 may be at least substantially fully sintered and disposed on a cutting element substrate 604. As shown in FIG. 7A, the cutting element 600 may be formed to have at least one chamfer surface 605.

A relatively thin (e.g., tape-cast) non-sintered (green) layer 606 comprising diamond grains may be applied to a surface of the chamfered diamond table 602 opposite the cutting element substrate 604. The layer 606 may be formulated to form a layer of polycrystalline diamond material that exhibits a different (e.g., higher or lower) wear resistance compared to the diamond table 602 upon sintering in an HTHP process. Optionally, one or more additional non-sintered (green) layers 608 comprising diamond grains may be applied over the first layer 606 to form an intermediate structure, which then may be sintered in an HTHP process, as previously described herein, to form a cutting element 610 shown in FIG. 7B. After forming the cutting element 610 shown in FIG. 7B, one or more chamfer surfaces 611 may be formed on the cutting element 610 to form a chamfered cutting element 612 shown in FIG. 7C. In additional embodiments, an HTHP sintering process may be used to sinter the first layer 606 to the cutting element 600 of FIG. 7A, after which an additional sintering process may be used to sinter the second layer 608 to a layer of polycrystalline diamond formed from the first layer 606.

Optionally, any of the above-described embodiments of cutting elements may be leached to remove catalyst matrix material from the interstitial spaces between the interbonded diamond grains in at least a portion of the diamond table. For example, at least one of polycrystalline diamond material at the front surface of a cutting element, polycrystalline diamond material at a lateral surface of a cutting element, and polycrystalline diamond material at chamfer surfaces of a cutting element may be exposed to a leaching agent in a leaching process to remove catalyst matrix material from the interstitial spaces between the interbonded diamond grains in at least a portion of the diamond table. For example, the diamond table may be leached to a depth of about three hundred (300) microns or less, or even about one hundred (100) microns or less. In some embodiments, catalyst matrix material may be left in place within at least a portion of the diamond table, while in other embodiments, the catalyst matrix material may be at least substantially entirely removed from the entire diamond table. The leaching process may be performed on a diamond table before the diamond table is attached to a substrate, or the leaching process may be performed on a diamond table after attaching the diamond table to, or forming the diamond table on, a substrate. Furthermore, a leaching process may be performed on a diamond table of a cutting element prior or subsequent to forming chamfer surfaces on the cutting element. Various leaching processes for removing catalyst matrix material from polycrystalline diamond material are known in the art.

Leaching the embodiments of cutting elements described herein may cause a shear lip to form at the wear scar of the cutting elements at an earlier stage of wear (i.e., when the wear scar is relatively small). Furthermore, in embodiments in which only a portion of the diamond table is leached, the leached layer or layers of the diamond table may extend into the diamond table less than an average thickness of any shear lip that might form in the diamond table, such that a double shear lip forms, wherein another, relatively smaller secondary shear lip forms in or on a relatively larger shear lip, wherein the relatively smaller secondary shear lip comprises a leached portion of the primary shear lip. Thus, the leached layer of the diamond table may provide greater definition to the shear lip, and may result in a relatively sharper leading, cutting edge of the shear lip, and may improve the regularity of the thickness of the shear lip.

The formation of a shear lip at a wear flat of a cutting element, in accordance with embodiments of the present invention, may reduce the normal and cutting forces, as the loading may be at least substantially carried by the shear lip, and not the entire wear flat.

Embodiments of cutting elements of the present invention, such as the cutting elements 100, 200, and 300 previously described herein, may be used to form embodiments of earth-boring tools of the present invention.

Figure 8:
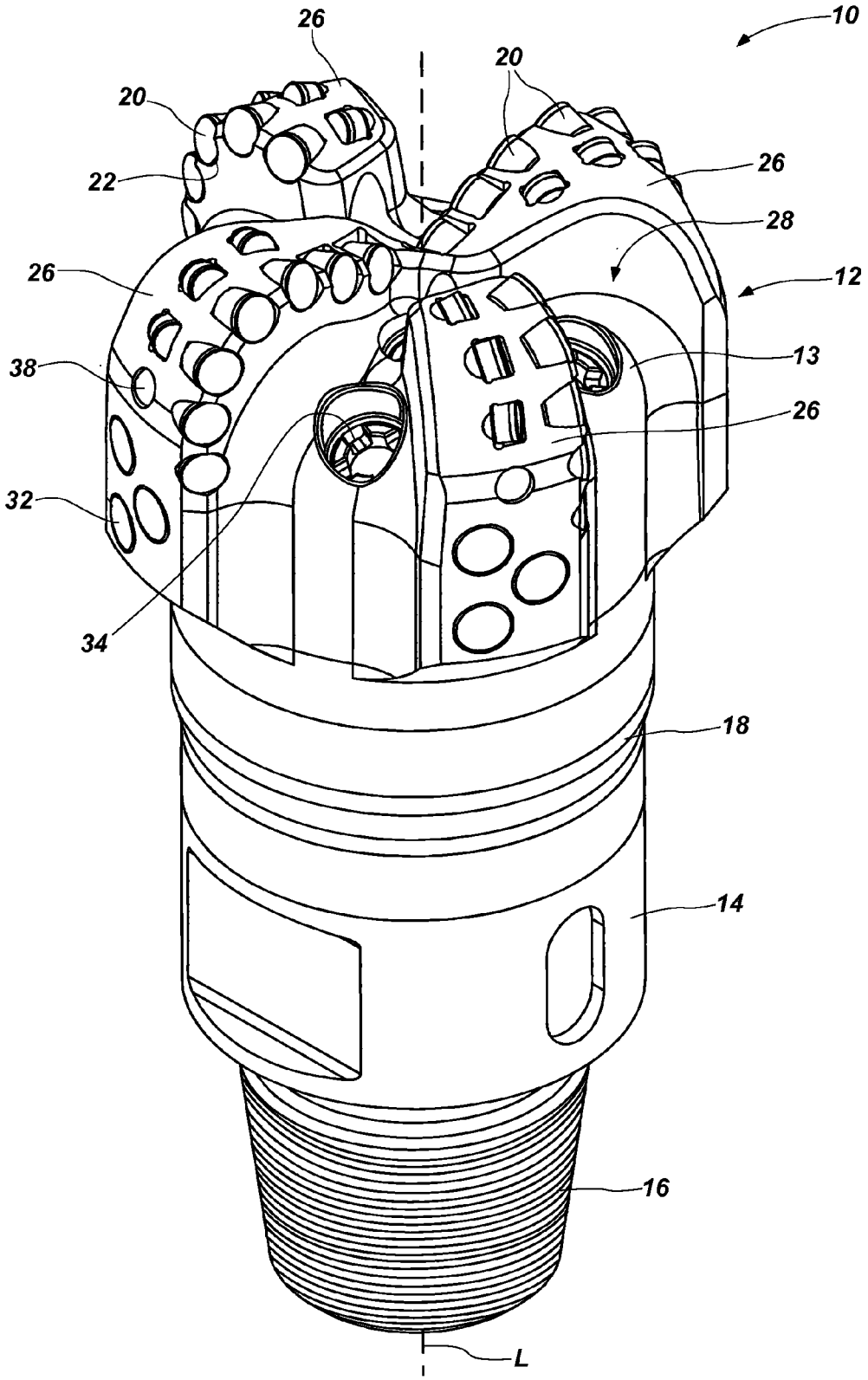
FIG. 8 is a perspective view of an embodiment of an earth-boring tool of the present invention that includes a plurality of cutting elements in accordance with embodiments of the present invention.

FIG. 8 is a perspective view of an embodiment of an earth-boring rotary drill bit 10 of the present invention that includes a plurality of cutting elements 20, which may comprise cutting elements according to any of the embodiments of cutting elements previously described herein. The earth-boring rotary drill bit 10 includes a bit body 12 that is secured to a shank 14 having a threaded connection portion 16 (e.g., an American Petroleum Institute (API) threaded connection portion) for attaching the drill bit 10 to a drill string (not shown). In some embodiments, such as that shown in FIG. 8, the bit body 12 may comprise a particle-matrix composite material, and may be secured to the metal shank 14 using an extension 18. In other embodiments, the bit body 12 may be secured to the shank 14 using a metal blank embedded within the particle-matrix composite bit body 12, or the bit body 12 may be secured directly to the shank 14.

The bit body 12 may include internal fluid passageways (not shown) that extend between the face 13 of the bit body 12 and a longitudinal bore (not shown), which extends through the shank 14, the extension 18, and partially through the bit body 12. Nozzle inserts 34 also may be provided at the face 13 of the bit body 12 within the internal fluid passageways. The bit body 12 may further include a plurality of blades 26 that are separated by junk slots 28. In some embodiments, the bit body 12 may include gage wear plugs 32 and wear knots 38. A plurality of cutting elements 20 as previously disclosed herein, may be mounted on the face 13 of the bit body 12 in cutting element pockets 22 that are located along each of the blades 26.

The cutting elements 20 are positioned to cut a subterranean formation being drilled while the drill bit 10 is rotated under weight on bit (WOB) in a borehole about centerline L.

Embodiments of cutting elements of the present invention also may be used as gauge trimmers, and may be used on other types of earth-boring tools. For example, embodiments of cutting elements of the present invention also may be used on cones of roller cone drill bits, on reamers, mills, bi-center bits, eccentric bits, coring bits, and so-called hybrid bits that include both fixed cutters and rolling cutters.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed, and legal equivalents. In addition, features from one embodiment may be combined with features of another embodiment while still being encompassed within the scope of the invention as contemplated by the inventors.

What is claimed is:

1. A cutting element for use in earth-boring tools, comprising:

a cutting element substrate;

a first layer of polycrystalline diamond material over a surface of the cutting element substrate, the first layer of polycrystalline diamond material exhibiting a first wear resistance; and a second layer of polycrystalline diamond material on a side of the first layer of polycrystalline diamond material opposite the cutting element substrate, the second layer of polycrystalline diamond material exhibiting a second wear resistance higher than the first wear resistance; and a break-in chamfer and a landing chamfer, wherein the first layer of polycrystalline diamond material, the second layer of polycrystalline diamond material, and the break-in chamfer and the landing chamfer are configured to encourage formation of a shear lip at a wear scar after the cutting element is partially worn upon cutting a formation with the cutting element, and wherein the break-in chamfer extends through at least a portion of the second layer of polycrystalline diamond material and the landing chamfer extends through at least a portion of the first layer of polycrystalline diamond material and at least a portion of the second layer of polycrystalline diamond material.

2. The cutting element of claim 1, wherein at least a portion of the second layer of polycrystalline diamond material is at least substantially free of catalyst matrix material in interstitial spaces between interbonded grains of diamond material in the second layer of polycrystalline diamond material.

3. A cutting element for use in earth-boring tools, comprising:

a cutting element substrate;

a first layer of polycrystalline diamond material adjacent a surface of the cutting element substrate, the first layer of polycrystalline diamond material exhibiting a first wear resistance;

a second layer of polycrystalline diamond material adjacent the first layer of polycrystalline diamond material opposite the cutting element substrate, the second layer of polycrystalline diamond material exhibiting a second wear resistance lower than the first wear resistance; and a third layer of polycrystalline diamond material adjacent the second layer of polycrystalline material opposite the first layer of polycrystalline diamond material, the third layer of polycrystalline diamond material having an exposed surface defining a front surface of the cutting element, the third layer of polycrystalline diamond material exhibiting a third wear resistance higher than the second wear resistance, and the first layer of polycrystalline diamond material exhibiting the first wear resistance between the second wear resistance and the third wear resistance.

4. The cutting element of claim 3, wherein differences between the first wear resistance, the second wear resistance, and the third wear resistance result in the formation of a shear lip at a wear scar on the cutting element after the cutting element is partially worn upon cutting a formation with the cutting element.

5. The cutting element of claim 3, wherein at least a portion of the third layer of polycrystalline diamond material is at least substantially free of catalyst matrix material in interstitial spaces between interbonded grains of diamond material in the third layer of polycrystalline diamond material.

6. A method of forming a cutting element for use in an earth-boring tool, comprising:

forming a first layer of polycrystalline diamond material over a surface of a cutting element substrate, and formulating the first layer of polycrystalline diamond material to exhibit a first wear resistance;

forming a second layer of polycrystalline diamond material on a side of the first layer of polycrystalline diamond material opposite the cutting element substrate, and formulating the second layer of polycrystalline diamond material to exhibit a second wear resistance higher than the first wear resistance; and forming a break-in chamfer and a landing chamfer, wherein the first layer of polycrystalline diamond material, the second layer of polycrystalline diamond material, and the break-in chamfer and the landing chamfer are configured to encourage formation of a shear lip at a wear scar after the cutting element is partially worn upon cutting a formation with the cutting element, and wherein the break-in chamfer extends through at least a portion of the second layer of polycrystalline diamond material and the landing chamfer extends through at least a portion of the first layer of polycrystalline diamond material and at least a portion of the second layer of polycrystalline diamond material.

7. The method of claim 6, further comprising removing catalyst matrix material from interstitial spaces between interbonded diamond grains in at least a portion of the second layer of polycrystalline diamond material.

8. The method of claim 6, further comprising:

forming at least one less than fully sintered disc including diamond grains; and subjecting the at least one less than fully sintered disc to an HTHP process to form at least one of the first layer of polycrystalline diamond material and the second layer of polycrystalline diamond material.

9. A method of forming a cutting element for use in an earth-boring tool, comprising:

forming a first layer of polycrystalline diamond material adjacent a surface of a cutting element substrate, and formulating the first layer of polycrystalline diamond material to exhibit a first wear resistance;

forming a second layer of polycrystalline diamond material adjacent the first layer of polycrystalline diamond material opposite the cutting element substrate, and formulating the second layer of polycrystalline diamond material to exhibit a second wear resistance lower than the first wear resistance; and forming a third layer of polycrystalline diamond material adjacent the second layer of polycrystalline material opposite the first layer of polycrystalline diamond material, forming the third layer of polycrystalline diamond material to have an exposed surface defining a front surface of the cutting element, formulating the third layer of polycrystalline diamond material to exhibit a third wear resistance higher than the second wear resistance, and formulating the first layer of polycrystalline diamond material to exhibit the first wear resistance between the second wear resistance and the third wear resistance.

10. The method of claim 9, further comprising selecting differences between the first wear resistance, the second wear resistance, and the third wear resistance to result in the formation of a shear lip at a wear scar on the cutting element after the cutting element is partially worn upon cutting a formation with the cutting element.

11. The method of claim 9, further comprising removing catalyst matrix material from interstitial spaces between interbonded diamond grains in at least a portion of the third layer of polycrystalline diamond material.

12. The method of claim 9, further comprising:

forming at least one less than fully sintered disc including diamond grains; and subjecting the at least one less than fully sintered disc to an HTHP process to form at least one of the first layer of polycrystalline diamond material, the second layer of polycrystalline diamond material, and the third layer of polycrystalline diamond material.

13. A method of forming a cutting element for use in an earth-boring tool, comprising:

forming a first layer of polycrystalline diamond material adjacent a surface of a cutting element substrate, and formulating the first layer of polycrystalline diamond material to exhibit a first wear resistance;

forming a second layer of polycrystalline diamond material adjacent the first layer of polycrystalline diamond material opposite the cutting element substrate, and formulating the second layer of polycrystalline diamond material to exhibit a second wear resistance higher than the first wear resistance; and forming a third layer of polycrystalline diamond material adjacent the second layer of polycrystalline material opposite the first layer of polycrystalline diamond material, forming the third layer of polycrystalline diamond material to have an exposed surface defining a front surface of the cutting element, and formulating the third layer of polycrystalline diamond material to exhibit a third wear resistance between the second wear resistance and the first wear resistance.

14. A method of cutting an earth formation using an earth-boring tool, comprising:

cutting the formation with a cutting element on the earth-boring tool, the cutting element comprising:

a cutting element substrate;

an outer layer of polycrystalline diamond material having an exposed surface defining a front surface of the cutting element, the outer layer of polycrystalline diamond material exhibiting a first wear resistance; and at least one layer of polycrystalline diamond material between the outer layer of polycrystalline diamond material and the cutting element substrate, the at least one layer of polycrystalline diamond material exhibiting a second wear resistance lower than the first wear resistance; and generating a single shear lip at a wear scar on the cutting element upon cutting the formation with the cutting element, the single shear lip generated by the at least one layer of polycrystalline diamond material wearing faster than the outer layer of polycrystalline diamond material; and at least substantially maintaining the single shear lip on the wear scar on the cutting element for a usable life of the cutting element.

15. An earth-boring tool, comprising:

a body; and at least one cutting element attached to the body, the at least one cutting element comprising:

a cutting element substrate;

a first layer of polycrystalline diamond material adjacent a surface of the cutting element substrate, the first layer of polycrystalline diamond material exhibiting a first wear resistance;

a second layer of polycrystalline diamond material adjacent the first layer of polycrystalline diamond material opposite the cutting element substrate, the second layer of polycrystalline diamond material exhibiting a second wear resistance lower than the first wear resistance; and a third layer of polycrystalline diamond material adjacent the second layer of polycrystalline material opposite the first layer of polycrystalline diamond material, the third layer of polycrystalline diamond material having an exposed surface defining a front surface of the cutting element, the third layer of polycrystalline diamond material exhibiting a third wear resistance higher than the second wear resistance, and the first layer of polycrystalline diamond material exhibiting the first wear resistance between the second wear resistance and the third wear resistance.

* * * * *